United States Patent [19]

Harsányi et al.

[11] Patent Number: 4,657,668

[45] Date of Patent: Apr. 14, 1987

[54] APPARATUS FOR THE SEPARATION OF SLURRY WITH DIFFERENT GRAIN SIZE INTO TWO PHASES IN A TANK

[75] Inventors: József Harsányi; Zoltán Kiss, both of Budapest; Ferenc Kukonya, Mosonmagyaróvár; János Pintér, Mosonmagyaróvár; Alajos Suri, Mosonmagyvaróvár; András Tóth, Mosonmagyaróvár, all of Hungary

[73] Assignee: Magyar Aluminiumipari Troszt, Budapest, Hungary

[21] Appl. No.: 704,733

[22] Filed: Feb. 25, 1985

[30] Foreign Application Priority Data

Feb. 28, 1984 [HU] Hungary ..... 800/84

[51] Int. Cl.[4] ..... B03B 5/62; B03B 5/64

[52] U.S. Cl. ..... 209/158; 209/155; 209/172

[58] Field of Search ..... 209/158, 160, 172.5, 209/172, 173, 146, 148, 150, 152, 155, 159, 161

[56] References Cited

U.S. PATENT DOCUMENTS

| | | | |
|---|---|---|---|
| 555,921 | 6/1866 | Boericke | 209/158 |
| 1,375,211 | 4/1921 | Cole | 209/158 |
| 1,989,937 | 2/1935 | Lessing et al. | 209/158 |
| 2,286,979 | 6/1942 | Samuel | 209/159 |
| 2,369,878 | 2/1945 | Wiegand | 209/158 |
| 2,597,108 | 5/1952 | Key | 209/158 |
| 2,843,265 | 7/1958 | Rakowsky | 209/172.5 |
| 3,295,677 | 1/1967 | Conddios | 209/158 |
| 4,039,425 | 8/1977 | Neavel | 209/158 |
| 4,483,768 | 11/1984 | Gazzoni | 209/158 |
| 4,539,103 | 9/1985 | Hollingsworth | 209/158 |

FOREIGN PATENT DOCUMENTS

| | | | |
|---|---|---|---|
| 104420 | 7/1938 | Australia | 209/172.5 |
| 1033601 | 3/1954 | Fed. Rep. of Germany | 209/159 |
| 1307454 | 11/1969 | Fed. Rep. of Germany | 209/158 |
| 656252 | 5/1929 | France | 209/173 |
| 360037 | 9/1937 | Italy | 209/160 |
| 117250 | 2/1959 | U.S.S.R. | 209/158 |

*Primary Examiner*—Kenneth M. Schor
*Assistant Examiner*—Thomas M. Lithgow
*Attorney, Agent, or Firm*—Karl F. Ross; Herbert Dubno

[57] ABSTRACT

An apparatus for separating a slurry into phases containing larger and smaller grains has an upright tank in which a plurality of downwardly extending inlet pipes open at their lower ends between outlets for the coarse and fine phases located at the bottom and top of the tank, respectively. At the lower end of each inlet pipe, an upwardly widening frustoconical cup is provided with a bottom confronting the open end of the inlet pipe to deflect the slurry upwardly and outwardly. Within the cup swirl vanes impart a swirl to the slurry.

14 Claims, 7 Drawing Figures

APPARATUS FOR THE SEPARATION OF SLURRY WITH DIFFERENT GRAIN SIZE INTO TWO PHASES IN A TANK

FIELD OF THE INVENTION

The invention relates to a process and an apparatus for the separation of slurry of a range of grain sizes into two phases in a tank in such a way that the grains predominantly smaller than a given grain size pass into the first phase and the grains predominantly larger than the given grain size pass into the second phase.

BACKGROUND OF THE INVENTION

It frequently is required in industry to separate a slurry containing different grain sizes in a wide range e.g. between 5 and 150 μm into two phases so that the grains predominantly smaller than a given grain size, e.g. 40 μm pass into the first phase, and those predominantly larger, than the given grain size pass into the second phase. This requirement exists for example in the alumina industry, where the slurry containing the precipitated alumina hydrate is transfered to a hydro-separator (primary thickener) which divides it into two phases according to the requirements. The hydro-separator is a tank with vertical axis having usually a conical bottom and being provided with overflow on the upper rim as well as with a slurry outlet stub on the lower end and a coaxical inlet pipe along its axis the lower end of which is submerged deeply in the slurry in the tank. In a steady-state operation mode the tank is full of slurry, the continuously supplied fresh slurry to be sized passes through the inlet pipe into the tank, flowing downwards, but since the outflow rate of the slurry outlet stub is less than the slurry-feed rate of the inlet pipe, a certain part of the slurry passes upwards to the overflow. As a result, three well distinguishable zones are formed in the tank. These are: so-called settling zone on the bottom, in which the slurry current moves slowly and steadily downwards; the so-called sizing zone above the level of the lower orifice of the inlet pipe in which the slurry current flows slowly and steadily upwards; and a so-called transition zone between the two zones, in which a certain part of the slurry moving downwards from the inlet pipe passes upwards with a 180° directional change.

It is known that in given liquid the final falling velocity of the grains consisting of given solid matter is dependent on the size and shape of the grains. Depending upon whether the final falling velocity is lower or higher than the velocity of the upward flowing liquid, the grains move upward or fall. The upwardly flowing grains pass into the overflow, the downwardly flowing grains into the lower part of the tank.

The hydro-separator works the more effectively the less is the number of the undesirable marginal grains passing into the lower part of the tank.

The drawback of known equipment for this purpose is that the direction of the flow in the transition zone is not definite; there the flow conditions are complex and dead spots develop. The dead spots do not participate in the sizing and a certain part of the slurry passes directly into the settling zone carrying away the solid grains independently from their sizes, the greater part after more or less swirling passes into the sizing zone where the sizing takes place virtually exclusively.

OBJECT OF THE INVENTION

The object of the invention is to eliminate the transition zone, i.e. to improve the passage of all of the grains into the sizing zone.

SUMMARY OF THE INVENTION

This object is achieved according to the invention in that during the separation of the slurry with different grain sizes into two phases in a tank wherein the grains predominantly smaller than a given grain size pass into the first phase and those predominantly larger than the given grain size pass into the second phase, the slurry is admitted into the tank at an angle of 91°–179°, preferably at 110°–160° to the direction of gravitation with 0.03–0.6 m/sec vertical and 0.1–1.2 m/sec horizontal exit velocity components. The feeding can be carried out at several locations on the same level. The feeding can be periodically interrupted at a certain part of the inlet locations.

Higher selectivity is attained if according to the invention a certain part of the phase with larger grain size—optionally in diluted condition—is forwarded into inlet pipes, the ends of which immersed in the slurry are at a lower or higher level than the ends of other slurry inlet pipes submerged in the slurry.

Advantageously in the case of varying slurry currents, the slurry is sized in a tank which is divided into several sectors by vertical separating plates or partitions and is admitted into the inlet pipes in the number of sectors corresponding to the optimum volumetric velocity of the slurry current flowing in the direction of the overflow.

The apparatus according to the invention is a tank with vertical axis the lower part of which is provided with a slurry outlet stub and the upper part with an overflow duct, as well as with a plurality of vertical inlet pipes, each of the inlet pipes being provided with a reversing chamber according to the invention. The reversing chambers are provided with swirl vanes.

It is suitable in certain cases that at least one vertical separating plate is arranged in the tank, the upper edge of which is above the level of the overflow duct, and its lower edge below the level of the reversing chambers.

The slurry outlet stub may be interconnected with a recirculation pipe which leads to additional inlet pipes. The reversing chambers of the additional inlet pipes are arranged on a level different from that of the reversing chambers of the primary inlet pipes. A mixer tank may be fitted into the recirculation line.

Thus according to the invention the slurry admitted through the inlet pipe is spread above the outlet port of the inlet pipe over the full cross section of the tank. If necessary, several parallel inlet pipes are used and their ends submerged in the slurry are arranged on the same level. According to another effective method a certain part of the phase containing the large grain size is—optionally after dilution—recycled to a secondary inlet pipe or pipes, the end or ends of which submerged in the slurry are on a level different than the end of the inlet pipes feeding in the original slurry to be sized. Namely in case of feeding on the same level, the sizing efficiency at the primary feeding height would become favorable. In case of a varying slurry current a tank is used, the inside of which is divided into several sectors by vertical separating plates and the slurry is admitted into the inlet pipes in the number of sectors corresponding to the optimum volumetric velocity of the slurry-current flowing in the direction of the overflow.

Thus in the apparatus according to the invention—differently from any other known apparatus—a reversing chamber is arranged below each inlet pipe, and is provided with swirl vanes. The inlet pipe is suitably equipped with flush pipe leading to the reversing chamber and being provided with a shut-off device. Further, the apparatus may contain one or more vertical separating plates arranged in the tank, the upper edge of which is above the level of the overflow and its lower edge below the level of the reversing chamber.

BRIEF DESCRIPTION OF THE DRAWING

The process and the apparatus according to the invention are described with the aid of the accompanying drawing, in which.

SPECIFIC DESCRIPTION

Figure 1:
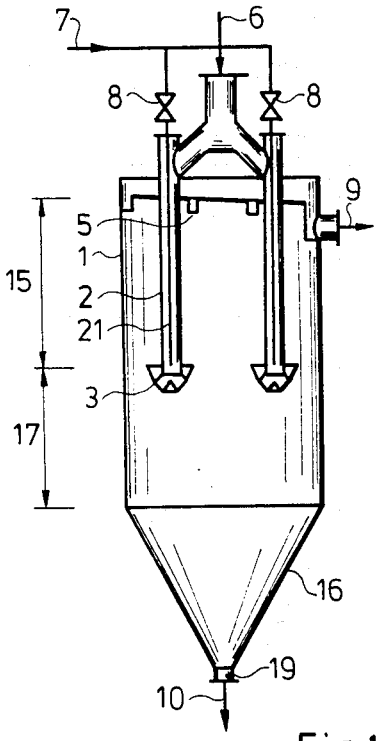
FIG. 1 is a vertical section of the slurry-sizing apparatus according to the invention.
Figure 2:
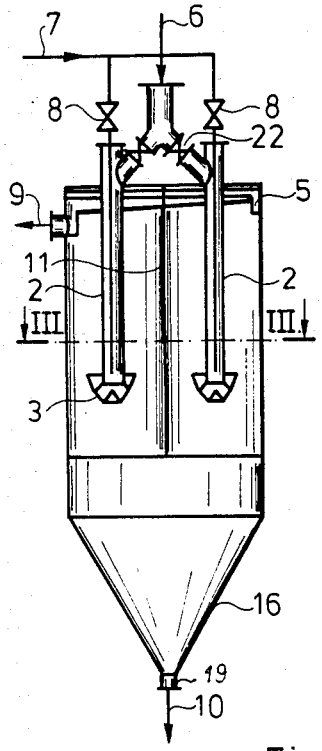
FIG. 2 is a vertical section of the apparatus provided with vertical separating plates.
Figure 3:
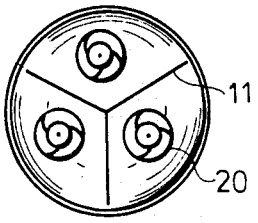
FIG. 3 is a horizontal cross section along line III—III of the apparatus shown in FIG. 2.

The apparatus shown in FIG. 1 is a cylindrical tank 1 with conical bottom 16, provided with overflow ducts 5 at its upper rim to which the fine grained slurry outlet stub 9 is connected. There are several inlet pipes 2 in the tank 1 each connected at the top to inlet 6 of the slurry to be sized and provided with reversing chambers 3 in the form of cups at the bottom; furthermore preferably three swirl vanes 4 are arranged in each reversing chamber 3. Each inlet pipe 2 has a coaxial inlet pipe 21 for the flush liquid, each flushing pipe is connected through the flush liquid inlet valve 8 to a flush liquid transport pipe 7. The lower end of the flush liquid inlet pipes 21 is higher than the lower end of the inlet pipes 2. In the tank 1 shown in FIGS. 2 and 3 there are three vertical separating plates 11 and three inlet pipes 2 and each is connected through a shut-off device 22 to the inlet 6 of the slurry to be sized. The upper edge of the separating plates 11 is above the inlet rim of the overflow duct 5, while the lower edge is below the level of the reversing chambers 3. Slurry outlet stub 10 provided with shut-off device 19 is arranged on the conical bottom 16 of tank 1.

Figure 4:
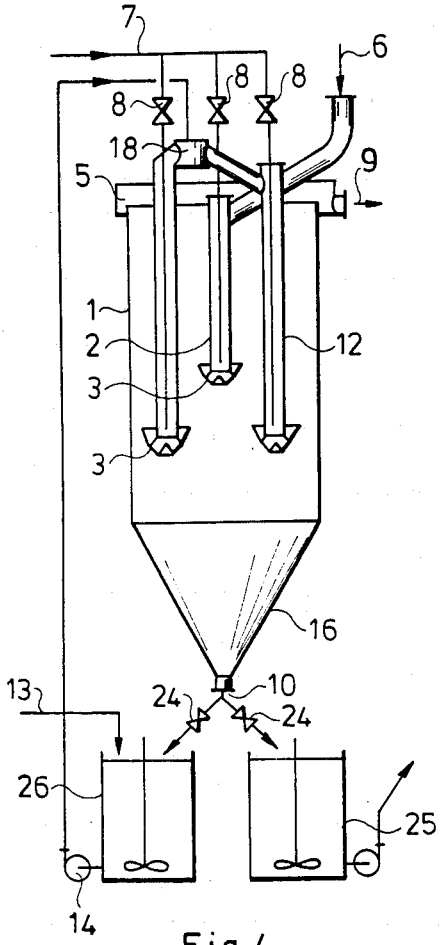
FIG. 4 is an apparatus suitable for sizing in two steps.
Figure 5:
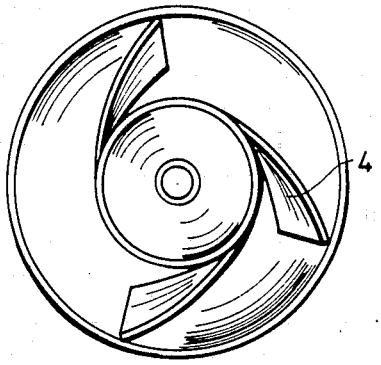
FIG. 5 is a top view of the reversing chamber provided with swirl vanes.
Figure 6:
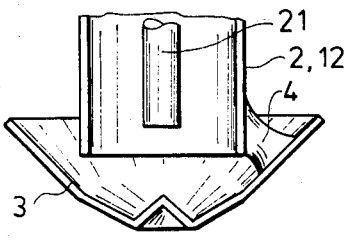
FIG. 6 is a vertical section of the reversing chamber provided with swirl vanes.

The tank 1 shown in FIG. 4 has additional inlet pipes 12—besides the inlet pipe—2, which are longer at the top and bottom than the inlet pipe 2, and they are provided with reversing chambers 3 at the bottom, and connected to the diluted coarse grained slurry transport pipe 23 at the top. In this apparatus the coarse grained slurry outlet stub 10 is of two-way construction, both branches are fitted with shut-off device 24 one of them leading to a tank 25 to receive the coarse grained slurry intended for further processing, while the other one leads to a tank 26 connected with the diluted liquid transport pipe 13. The tank 26 is tapped by pump 14 at the bottom, the delivery side of which is connected to the diluted coarse grained slurry transport pipe 23.

The process in stationary operation is the following: the tank 1 is full with slurry. Fresh slurry to be sized flows through inlet 6 into the inlet pipes 2 during operation. The fresh slurry agitated by swirl vanes 4 arranged in the reversing chambers 3 at the lower end of the inlet pipes 2 moves with upward vertical and horizontal flow components into the slurry in the tank 1 in such a way that upward from the outflow it fills out the full cross section of the tank shutting off the downflow of the slurry. Thus only the coarse grained phase of the already sized slurry flows towards the lower conical part of the tank 1. The velocity of the fine average grained slurry flowing upwards in the flow zone 15 of the tank 1 as well as the proportion of the fine grains passing into the settling zone 17 are controlled with the ratio of the input of the fresh slurry to be sized and the output of the coarse grained phase. The velocity of the upward flowing slurry is set as to eliminate as far as possible the entry of the grains larger than the critical size at the level of the overflow duct 5. With the apparatus and the process according to the invention the proportion of the grains smaller than the critical size will be minimal in the settling zone 17.

This ratio can be reduced even more with the apparatus shown in FIG. 4. Here a certain part of the primarily obtained coarse grained slurry is forwarded into the tank 26 (by opening of the shut-off device 24) where diluent is mixed to it through pipe 13, then delivered through pipe 23 by pump 14 into the distributor 18 used for distribution of the diluted coarse grained slurry, from there into the diluted coarse grained slurry transport inlet pipes 12 which spread the slurry over the full cross section of the tank 1. The diluted coarse grained slurry contains less fine grains than the original slurry to be sized, and a certain part of the fine grained fraction forwarded toward the overflow duct 5. Due to this recirculation process during the secondary sizing, the sizing is intensified.

The size of the upward flowing grains is clearly determined by the velocity of the upward flowing slurry in the flow zone 15. This velocity is dependent on the volumetric velocity existing in the inlet 6 feeding in the slurry to be sized and in the stub 10 ensuring the discharge of the coarse grained slurry. The cross section of the tank 1 is generally dimensioned for the optimum of these volumetric velocities can not be constantly maintained in the practice, which results in imperfect quality of the sizing process. This shortcoming is eliminated by the apparatus shown in FIGS. 2 and 3, where the tank 1 is divided into several vertical spaces—three in case of the diagrams—with the aid of the separating plates 11. When the production drops approximately to its two third, one of the shut-off devices 22 is closed, and when it drops to one third, then two shut-off devices are closed. The shut-off device 19 of the stub 10 used for discharge of the coarse grained slurry is closed according to the same proportion. The third or the second and third space remaining in operation will carry out the sizing of the same quality as the apparatus under full load.

The reversing chambers 3 are cleaned from the incidentally settled sludge in stationary operation through the flush liquid inlet pipes 21 within a few minutes once a day or once in several days, depending on the properties of the slurry.

The invention is demonstrated by way of examples as follows:

EXAMPLE 1

Agitated slurry of alumina hydrate containing 500 g solids of 3–200 μm grain size per liter, the temperature of which is 40° C. and the density 1.6 g/cm$^3$ is processed for the separation of the fraction, the grain size of which is smaller than 40 μm. The 45 μm grain fraction represents 10% in the slurry.

Slurry at the rate of 100 m$^3$/h is admitted into a 3.2 m diameter, 8 m high cylindrical tank with conical bottom to which three inlet pipes are attached. Reversing chambers provided with swirl vanes are at the end of the inlet pipes at a depth of 3 m from the upper level of the slurry. The tank is divided into three parts by vertical separating plates in such a way that an inlet pipe extends into each sector. The separation is carried out so that 33 m$^3$/h slurry is admitted through each inlet head into the tank with 0.4 m/s vertical and 0.2 m/s horizontal velocity components.

70 m$^3$/h slurry is discharged through the upper outlet stub of the tank, the density of which is 1.3 g/cm$^3$, and its solid content is 200 g/l. The grain size of the solid matter is 1–45 μm.

From the conical shaped lower part of the tank 30 m$^3$/h product containing 850 g/l solids are removed the density of which is 1.68 g/cm$^3$. The grain size of the solid material ranges 45–150 μm. The 45 μm grain fraction of the solids in the product is 4%.

EXAMPLE 2

Agitated alumina hydrate slurry—the characteristics of which are the same as those given in example 1—containing 10% of 45 μm grain fraction is processed with recirculation.

110 m$^3$ slurry per hur is admitted into a tank, which differs from the tank described in example 1 in that it has no vertical separating plates, at the same time however in addition to the mentioned three inlet pipes it is provided with a fourth similar inlet pipe. The outlet part of this latter one is arranged at a depth of 2.5 m from the slurry level. The separation is the same as described in example 1 with the difference that a quantity of 10 m$^3$/h from the slurry containing 850 g/l solids and emerging from the lower outlet stub of the apparatus is conducted into the mixer tank. 5 m$^3$/h spent liquor of Bayer type alumina production is added to it in the tank, then it is conducted into the inlet pipe, the outlet port of which is arranged at a depth of 2.5 m below the slurry level.

In the course of the separation carried out with partial recirculation, 7.8 m$^3$/h slurry of 1.3 g/cm$^3$ density is discharged through the upper outlet port of the apparatus. This slurry contains 200 g/l solid matter. The grain size of the solid matter is 1–45 μm.

32 m$^3$/h product is discharged through the lower part of the apparatus. The density of the product is 1.6 g/cm$^3$ and the solid content is 850 g/l. The grain size of the solid matter is 45–150 μm. The 45 μm grain fraction is 3%.

Figure 7:
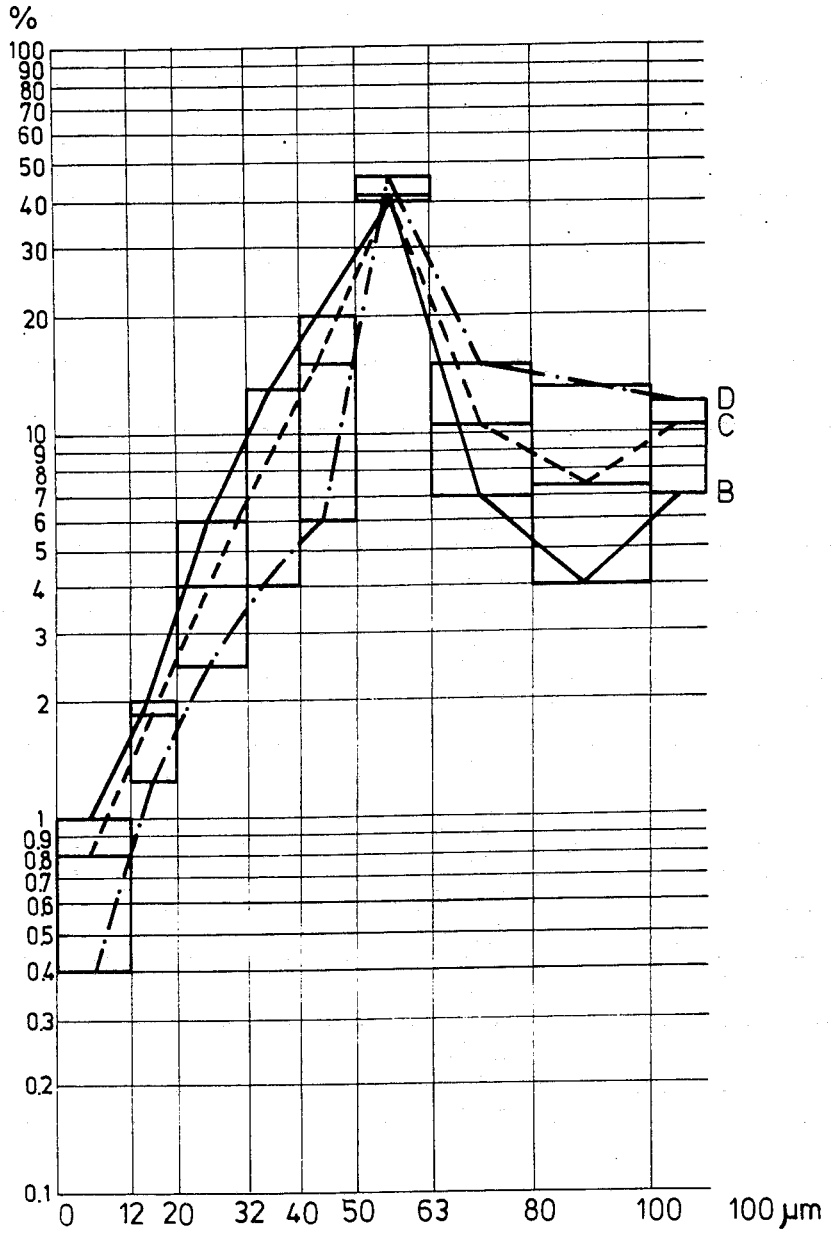
FIG. 7 is a grain distribution diagram.

The advantages of the invention in comparison with the conventional process and apparatus are demonstrated in Table I. and by the diagram prepared with its use (FIG. 7). These indicate the data of the experiment conducted in an alumina factory at operational level. The percentual grain size distribution was measured in the admitted slurry to be sized and in the slurry leaving the stub 10 according to the conventional process and that of the invention. The proportion of the grains smaller than 40 μm amounts to 22% in the admitted slurry. In case of the lower discharge through the outlet stub 10 this was reduced to 15.6% by the convenional process and to 8% by the process according to the invention.

The histogram and distribution curves of the solid phase admitted into the separator and discharged through the lower outlets are shown in FIG. 7 based on the data of the Table. The grain size in μm is shown on the abscissa and the quantity in weight % on the logarithmic scale of the ordinate.

In the diagram B=slurry to be sized, C=conventional lower discharge, D=lower discharge according to the invention. Slurry with 420 g/l solid content was used in the operational experiment.

TABLE I

| Grain size μm | Input % | Conventional lower output % | Lower output according to the invention % |
|---|---|---|---|
| 0–12 | 1.0 | 0.8 | 0.4 |
| 12–20 | 2.0 | 1.8 | 1.2 |
| 20–32 | 6.0 | 4.0 | 2.4 |
| 32–40 | 13.0 | 9.0 | 4.0 |
| 40–50 | 20.0 | 15.0 | 6.0 |
| 50–53 | 40.0 | 41.0 | 46.0 |
| 63–80 | 7.0 | 10.5 | 15.0 |
| 80–100 | 4.0 | 7.4 | 13.0 |
| >100 | 7.0 | 10.5 | 12.0 |
| TOTAL | | | |
| <40 | 22.0 | 15.6 | 8.0 |
| >40 | 78.0 | 84.4 | 92.0 |

What we claim is:

1. An apparatus for separating a slurry containing a particulate of a range of grain sizes into a first phase containing relatively large-grain particles and a second phase containing relatively small-grain particles, said apparatus comprising:

an upright tank having a vertical axis;

means forming an outlet for said first phase at a lower portion of said tank;

means forming an outlet for said second phase at an upper portion of said tank;

a plurality of inlet pipes in mutually spaced relation extending downwardly into said tank generally parallel to said axis and having lower ends opening in said tank between said inlet and said outlet for discharging said slurry downwardly into said tank;

a respective upwardly open deflector cup aligned with and surrounding each of said lower ends and receiving said slurry therefrom, each of said cups frustoconically widening upwardly from a bottom confronting the respective opening at the end of the respective pipe whereby each cup reverses the downward flow of slurry and redirects each downward flow upwardly and outwardly into said tank; and swirl vanes in each of said cups for imparting a swirl to the reversed flow of said slurry redirected by said cups into said tank.

2. The apparatus defined in claim 1 wherein each of said bottoms is formed with an upwardly converging conical projection aligned with the respective opening of the respective pipe end.

3. The apparatus defined in claim 1 wherein said tank is provided with at least one vertical partition between two of said pipes, said partition having a lower horizontal edge below said cups and an upper horizontal edge lying above the level of an overflow duct forming said outlet for said second phase.

4. The apparatus defined in claim 1, further comprising a recirculation pipe connecting said outlet for said first phase with at least one of said inlet pipes for recirculating slurry thereto.

5. The apparatus defined in claim 4 wherein said recirculation pipe is connected with a plurality of said inlet pipes.

6. The apparatus defined in claim 4 wherein at least some of said cups are located at levels different from another of said cups in said tank.

7. The apparatus defined in claim 4 wherein a mixing tank is connected between said outlet for said first phase and said recirculation pipe.

8. The apparatus defined in claim 1 wherein each of said bottoms is formed with an upwardly converging conical projection aligned with the respective opening of the respective pipe end, and each of said inlet pipes has coaxially received therein a respective flushing liquid pipe opening at a lower end thereof directly above the respective conical projection.

9. The apparatus defined in claim 8 wherein said tank is provided with at least one vertical partition between two of said pipes, said partition having a lower horizontal edge below said cups and an upper horizontal edge lying above the level of an overflow duct forming said outlet for said second phase.

10. The apparatus defined in claim 8, further comprising a recirculation pipe connecting said outlet for said first phase with at least one of said inlet pipes for recirculating slurry thereto.

11. The apparatus defined in claim 10 wherein said recirculation pipe is connected with a plurality of said inlet pipes.

12. The apparatus defined in claim 10 wherein at least some of said cups are located at levels different from another of said cups in said tank.

13. The apparatus defined in claim 10 wherein a mixing tank is connected between said outlet for said first phase and said recirculation pipe.

14. An apparatus for separating a slurry containing a particulate of a range of grain sizes into a first phase containing relatively large-grain particles and a second phase containing relatively small-grain particles, said apparatus comprising:

an upright tank having a vertical axis;

means forming an outlet for said first phase at a lower portion of said tank;

means forming an outlet for said second phase at an upper portion of said tank;

a plurality of inlet pipes in mutually spaced relation extending downwardly into said tank generally parallel to said axis and having lower ends opening in said tank between said inlet and said outlet for discharging said slurry downwardly into said tank;

a respective upwardly open deflector cup aligned with and surrounding each of said lower ends and receiving said slurry therefrom, each of said cups frustoconically widening upwardly from a bottom confronting the respective opening at the end of the respective pipe whereby each cup reverses the downward flow of slurry and redirects each downward flow upwardly and outwardly into said tank, each of said bottoms being formed with an upwardly converging conical projection aligned with the respective opening of the respective pipe end;

respective flushing liquid pipes extending coaxially in each of said inlet tubes and terminating above the respective opening in line with the respective conical projection while opening downwardly in the direction thereof; and swirl vanes in each of said cups for imparting a swirl to the reversed flow of said slurry redirected by said cups into said tank.

* * * * *